US005079469A

United States Patent [19]

Bongianni

[11] Patent Number: 5,079,469

[45] Date of Patent: Jan. 7, 1992

[54] PIEZONUCLEAR BATTERY

[75] Inventor: Wayne L. Bongianni, Los Alamos, N. Mex.

[73] Assignee: The United State of America as represented by the United States Department of Energy, Washington, D.C.

[21] Appl. No.: 597,227

[22] Filed: Oct. 15, 1990

[51] Int. Cl.[5] ..... G21H 1/00

[52] U.S. Cl. ..... 310/301; 310/302; 136/202

[58] Field of Search ..... 310/301, 302; 429/5; 313/54; 136/202, 253

[56] References Cited

U.S. PATENT DOCUMENTS

| | | | |
|---|---|---|---|
| 2,266,738 | 12/1941 | Byler et al. | 310/301 |
| 2,575,134 | 11/1951 | Schultz et al. | 310/301 |
| 2,900,535 | 8/1959 | Thomas | 310/302 |
| 3,767,947 | 10/1973 | Adler et al. | 310/302 |

FOREIGN PATENT DOCUMENTS 8004371 3/1982 Brazil .

OTHER PUBLICATIONS

Uda et al., "Characteristics of a Foil-Type Electret Dosimeter For A Surface Alpha Contamination Monitor", 11/86, Nuclear Technology, vol. 75, pp. 215-221.

*Primary Examiner*—Nelson Moskowitz
*Attorney, Agent, or Firm*—Ray G. Wilson; Paul D. Gaetjens; William R. Moser

[57] ABSTRACT

A piezonuclear battery generates output power arising from the piezoelectric voltage produced from radioactive decay particles interacting with a piezoelectric medium. Radioactive particle energy may directly create an acoustic wave in the piezoelectric medium or a moderator may be used to generate collision particles for interacting with the medium. In one embodiment a radioactive material ($^{252}Cf$) with an output of about 1 microwatt produced a 12 nanowatt output (1.2% conversion efficiency) from a piezoelectric copolymer of vinylidene fluoride/trifluorethylene.

7 Claims, 4 Drawing Sheets

PIEZONUCLEAR BATTERY

BACKGROUND OF THE INVENTION

This invention relates to the conversion of nuclear energy to electrical energy and, more particularly, to the piezoelectric conversion of fission fragment energy to electrical energy. This invention is the result of a contract with the Department of Energy (Contract No. W-7405-ENG-36).

Nuclear fission releases substantial energy. For example, a single fission of a $U^{235}$ atom will produce $3.2\times10^{-11}$ watt-second, with the energy carried in two fission fragments and about two and a half neutrons on an average. The fission fragments are roughly equal in mass with an energy of about 100 Mev. Thus, fissioning one gram of $U^{235}$ would produce 23 Mw-hours of energy, or the equivalent of about 4,000 gallons of gasoline, if fissioned completely.

Fission energy is typically converted to electrical energy by a thermal process. Nuclear reactors capture the fission fragment energy in surrounding fuel, structure, and moderator, wherein a coolant removes the heat energy for transfer through a heat exchanger to produce steam for driving a turbine and connected electrical generator. Thermionic converters directly convert the heat to electrical energy. However, nuclear reactors are necessarily large and complex devices that output megawatts of power. Thermionic devices are relatively inefficient and generate waste heat for disposal.

It would be desirable to convert nuclear fission energy directly to electrical energy. This conversion is accomplished by the present invention wherein a piezoelectric film generates an output voltage in response to fission fragment energy.

It is an object of the present invention to convert nuclear fission energy to electrical energy using a piezoelectric effect.

It is another object of the present invention to provide portable converters for directly converting energy from radioactive decay particle emissions to electrical energy.

One other object is to provide for using fissionable nuclear waste to generate electricity.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF INVENTION

To achieve the foregoing and other objects, and in accordance with the purposes of the present invention, as embodied and broadly described herein, the apparatus of this invention may comprise a piezonuclear battery. A radioactive material forming an emitting surface for particle emissions is located adjacent an acoustic wave generating medium. Particles emitted from the emitting surface are received by and interact with the medium to generate an acoustic wave. A piezoelectric material is operably placed for receiving the acoustic wave and producing an output voltage with a predetermined polarity.

In another embodiment of the present invention, a radioactive material forming an emitting surface for particle emissions is operably located adjacent a piezoelectric material to receive the particle emissions. The particles interact with the piezoelectric material to generate an acoustic wave in the piezoelectric material effective to produce an output voltage with a predetermined polarity.

In one other embodiment, the invention may comprise a method for producing electrical energy directly from radioactive material. Particles are emitted from a radioactive material and interact with an adjacent medium to generate an acoustic wave. The acoustic wave is directed toward a piezoelectric material and generates an electrical voltage with a predetermined voltage from strains induced by the acoustic wave in the piezoelectric material.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

In accordance with the present invention, the energy in particles emitted from a radioactive material is converted to an acoustic wave that interacts with a piezoelectric material to generate a voltage at a predetermined polarity. The acoustic wave may be generated directly in the piezoelectric material or may be generated in an adjacent medium that more efficiently interacts with the emitted particles than does the piezoelectric medium.

As used herein, the term "radioactive material" means any material that undergoes a radioactive decay, i.e., the emission of particles from a nucleus, of orbital electrons, or of fission fragments. Examples of such materials include $^{235}U$, $^{252}Cf$, $^{241}Am$, depleted U, etc. The term "piezoelectric" means any material that generates a voltage when a mechanical force is applied.

When another material is interposed between the piezoelectric medium and the emitter, the term moderator will be used. This is appropriate, particularly with respect to the "knock-on" model of energy coupling. In this model the fission fragments are slowed for more efficient elastic nuclear collisions. The moderator also protects the piezoelectric from fission fragment damage.

Figure 1:
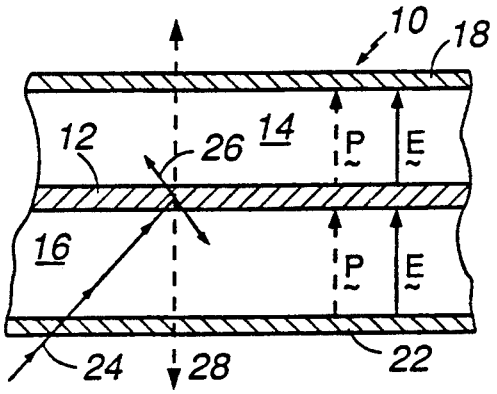
FIG. 1 is a cross-sectional view of one embodiment of a piezonuclear battery according to the present invention.

Referring now to FIG. 1, there is shown one embodiment of the present invention in cross-section, forming a "sandwich" 10 for possible use in a battery. Layer 12 of radioactive material is sandwiched between piezoelectric film layers 14 and 16. Piezoelectric layers 14 and 16 are poled to produce voltage polarities in opposite directions in response to mechanical stress. Conductive layers 18 and 22 are deposited on piezoelectric films 14 and 16, respectively, for current transmission. As shown in FIG. 1, radioactive layer 12 is comprised of a fissionable material that requires an incident slow neutron 24 to generate a fission event. An exemplary fission event releases fission fragments 26 into piezoelectric films 14 and 16 and fast neutrons 28 that escape from the "sandwich" 10. Fission fragments 26 have a range less than the thickness of piezoelectric layers 14 and 16 and the track terminates within the respective layer.

Figure 2:
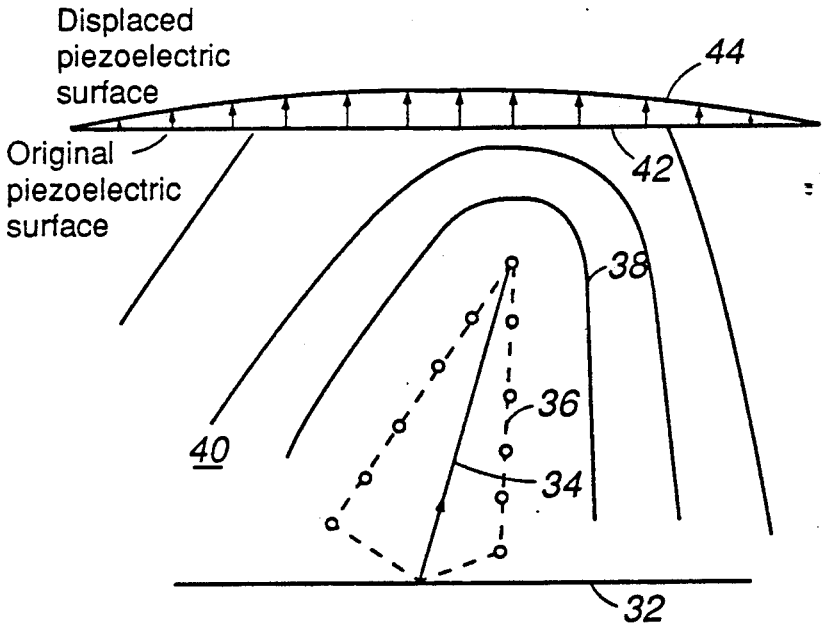
FIG. 2 is a schematic representation of the operation of a piezonuclear battery as exemplified in FIG. 1.

One theory of the operation of the piezonuclear effect is shown in FIG. 2, where fission fragments 34 give rise to an acoustic wavefront 38 that ultimately expands the film, where the film thereafter relaxes to its original state. The relatively short range of fission fragments 34 is due to the Coulomb charge carried by the fragment and the resulting acceleration imparted to electrons from the surrounding molecules. As the fission fragments slow, and lose charge, the elastic collisions with the nucleii, or knock-on's, of the material begin to dominate over the electronic collisions. The stopping distance is proportional to the mass of the particle, but inversely proportional to the square of the charge. For example, for a particle with about 1 Mev per atomic mass, the expected range is about 1 micron for electrons and 10 microns for knock-ons in a polymer piezoelectric material.

Fission fragment 34 imparts energy, i.e. velocity, to the electrons and nuclear particles resulting from electronic and elastic nuclear collisions, where the imparted velocity declines as fission fragment 34 traverses the material adjacent emitting surface 32 of the radioactive material. Thus, the scattered electrons and nucleons 36 carry their energy into acoustic medium 40 substantially simultaneously, forming a cone-shaped volume from which acoustic wave 38 emanates. The cone surface represents a shock front, behind which the scattered electrons and nucleons have given up their momentum to the lattice of the material. All points on this surface act as point sources for an acoustic wave that propagates outward until reflected at a boundary. If the boundary 42 is an original piezoelectric material surface, the displaced film surface 44 results in an electrical field having a polarity determined by the dipole orientation of molecules forming the piezoelectric material.

By way of example, radioactive material layer 12 may be formed from $^{235}U$ and the piezoelectric material forming surface 42 may be a vinylidene fluoride/trifluorethylene ($VF_2/F_3E$) copolymer fabricated using the process described in W. L. Bongianni, "Effect of Crystallization and Anneal on Thin Films of Vinylidene Fluoride/Trifluorethylene ($VF_2/F_3E$) Copolymers," 103 Ferroelectrics, pp. 57–65 (1990), incorporated herein by reference.

The range of an electron in matter (mg/cm$^2$) is given by $$R_e = 412\ T_o^{1.265-0.0954T_o}, \quad (1)$$

where $T_o$ is the electron energy in Mev. The maximum energy imparted to electrons by the fission fragments is 0.1c and the resulting electron range is about 0.7 microns. The cone angle of the scattered electrons is $$\sin\theta = R_e/R_f, \quad (2)$$

where $R_f$ is the fission particle range, giving a solid angle of about 90 degrees.

The area over which the piezoelectric surface 42 is displaced, or the area of transduction for converting the mechanical energy to electrical energy, is $$A = \pi(t \sin\theta/2 + R_e) \quad (3)$$

where t is the acoustic medium thickness. The radiation resistance of this area is $$R_a = (8/\pi^2)k^2 Q_A X_f \quad (4)$$

where k is the coupling coefficient, $Q_A$ is the quality factor associated with acoustic loss, and $X_f$ is the capacitance reactance associated with the fission fragment impulse area $$X_f = 1/(2\pi f C_f)$$

$$C_f = (\epsilon/\epsilon_o)\epsilon_o A/t \quad (5)$$

where f is the film resonance frequency and $\epsilon/\epsilon_o$ is the relative dielectric constant.

For 28/73 mol% $P(VF_2/F_3E)$ film, k is 0.3, $Q_A \approx 20$, and $\epsilon/\epsilon_o = 6$. As shown in FIG. 1, piezoelectric film 14 or 16 is also the acoustic medium 40 (FIG. 2). For a 2 micrometer thick film, the resonance frequency is 500 MHz. The resistance for a single fission event is about 1 megohm using these values, or an output resistance of $R_a/n \approx 15$ ohms for a 1 kW power supply with $3 \times 10^{13}$ fissions per second or $n = 6 \times 10^4$ fissions per transit time. The voltage developed by the resulting impulse area is 180 volts, well within the breakdown value of the film.

Figure 3:
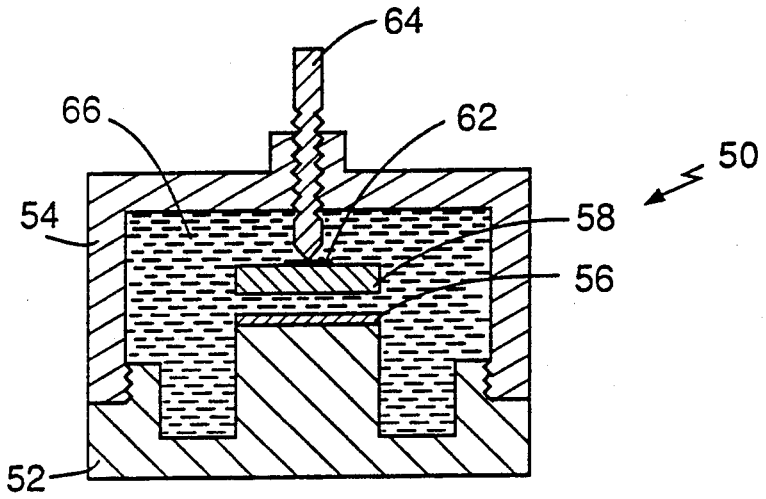
FIG. 3 is a cross-sectional view of another embodiment of a piezonuclear battery according to the present invention.

Referring now to FIG. 3, another embodiment of the present invention is shown in cross-section to depict piezonuclear battery 50 with radioactive material source 56 and facing piezoelectric polymer 58. The battery elements 56 and 58 are contained within lower case 52 and upper case 54. Electrical contact 62 is formed on polymer 58 where screw contact 64 establishes an electrical connection with contact 62 and allows polymer 58 to contact radioactive material 56 or to be selectively displaced above radioactive material 56.

In a first experiment, a 50 μCi source of $^{252}Cf$ (100 nanogram source with an output of 1 μwatt) was electro-deposited as a spot of 0.2 inches diameter on a platinum foil substrate and overcoated with a passivation layer of 50 μg/cm$^2$ gold. Piezoelectric polymer 58 was formed of $VF_2/F_3E$ and placed in direct contact with source 56. An output of 2 nanowatts was produced into a 33 ohm load.

In another experiment, an acoustic wave medium, or moderator, was placed inside cases 52, 54 and polymer 58 was displaced from source 56 using screw contact 64. The moderator was introduced to maximize the energy transfer from fission fragments wherein the energy of the fission fragments is dissipated by ionizing collisions and direct nuclear collisions within the moderator. In this experiment, water was selected as the moderator and the polymer film floated in the water against screw contact 64.

Figure 4:
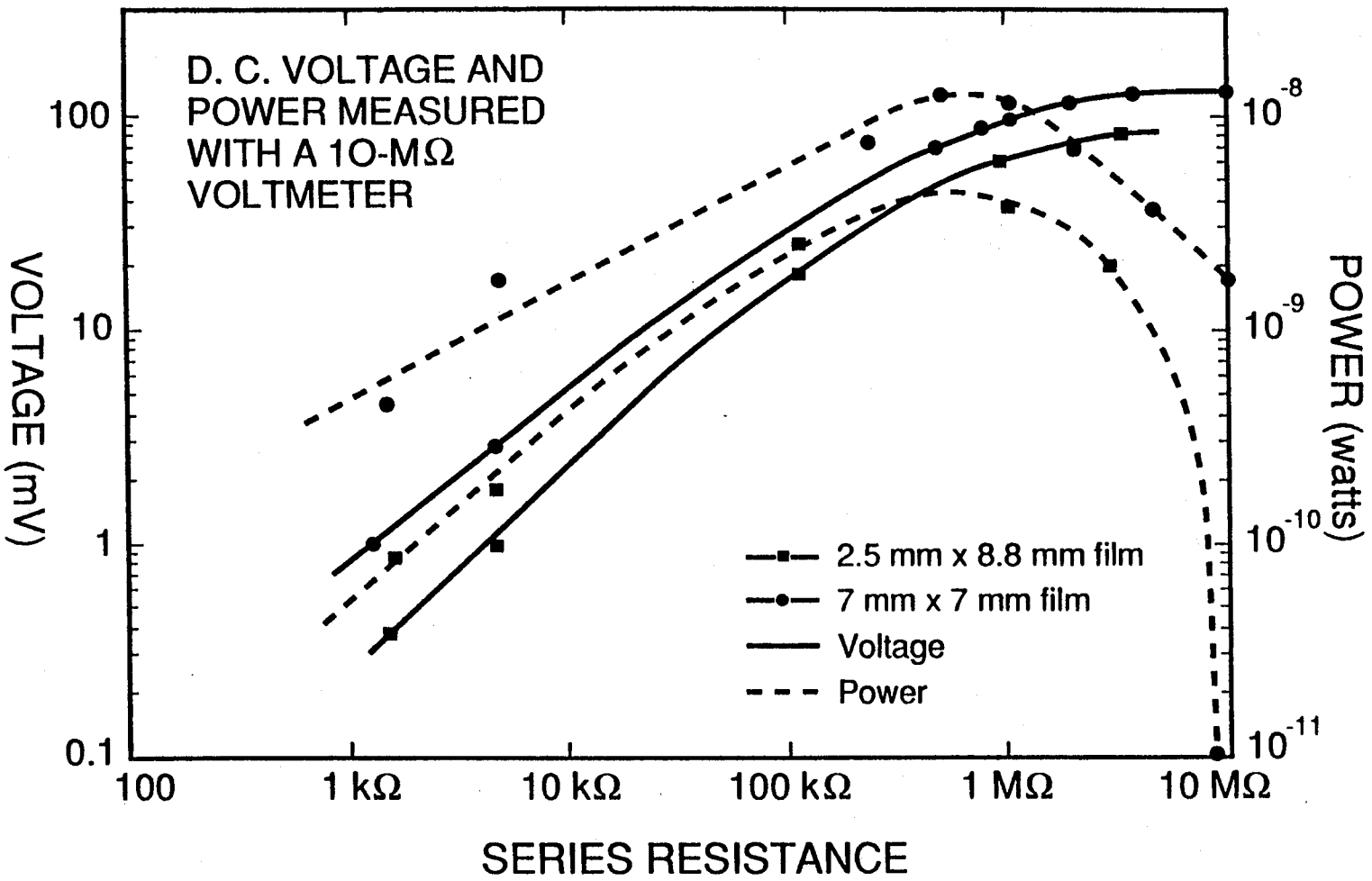
FIG. 4 is the measured output performance of a piezonuclear battery shown in FIG. 3.

FIG. 4 graphically illustrates the performance of piezonuclear battery 50 with polymer 58 displaced about 40μm above source 56 and with two different polymer 58 areas. The battery 50 output was input to a 10 MΩ voltmeter and provided a maximum energy output of about 12 nanowatts, i.e. about a 1.2% conversion efficiency from the 1 μwatt source 56. Increasing the area of polymer 58 provided an increase in both output voltage and power. It will also be appreciated that the arrangement of source 56, polymer 58, and medium 66 is self-rectifying when the fission fragments traverse the film. Electrons produced by ionizing collisions accumulate on polymer film 58 and remain on the film to maintain current flow between fission events. Medium 66 is conductive during ionization from fission fragment interaction to complete the circuit from ground to the case and is nonconductive between fission events.

Figure 5:
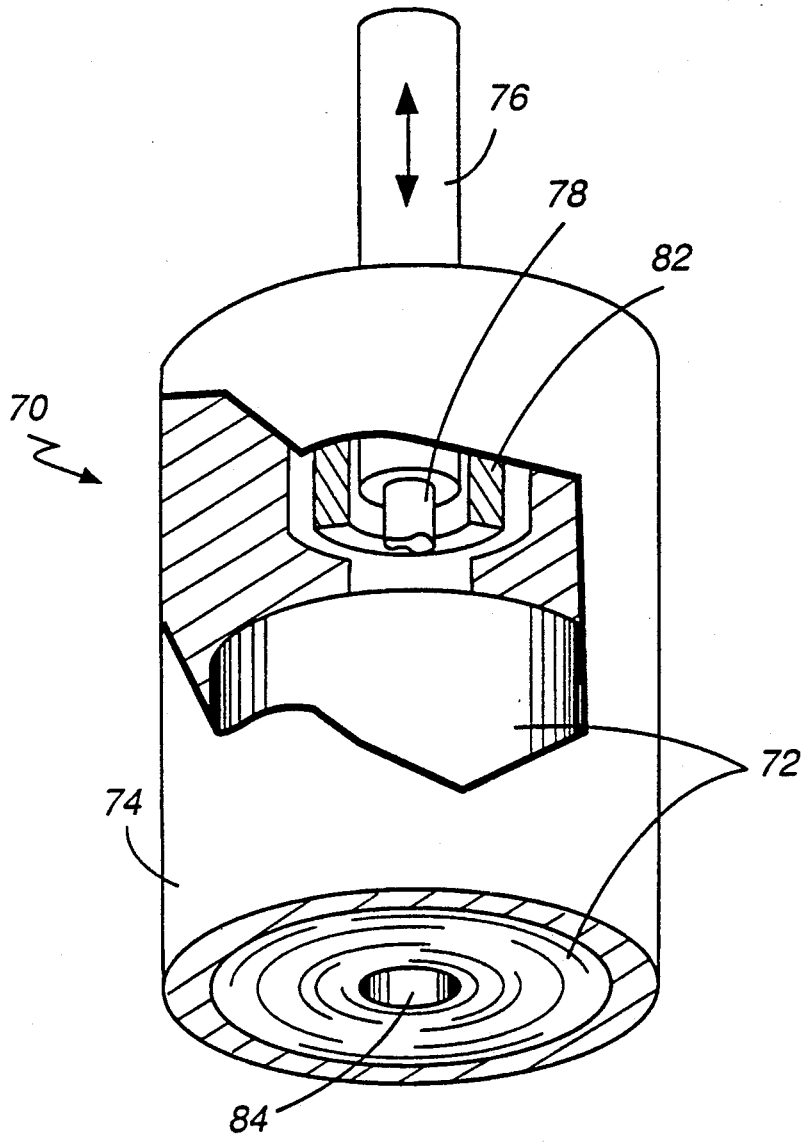
FIG. 5 is a pictorial view in partial cutaway of yet another embodiment of the present invention.

In one embodiment, a practical battery 70 might look like the variable power source of FIG. 5. The layered structure of FIG. 1 is wound into a roll 72 and placed in a neutron reflector 74 such as graphite. Its thickness may be many neutron moderation layers deep, so that fission multiplication (or a chain reaction) takes place, but is too thin for criticality to be reached. As control rod 76 with neutron source 78 is moved from absorbing housing 82 through access port 84, neutrons from source 78 will generate acoustic waves in rolled film 72 with concomitant piezoelectric effect. Alternately, neutron producing material could be included in the rolled film structure 72, and the reaction could be controlled by inserting control rod 76 of a neutron absorbing material.

The above examples are certainly not limited to the specific materials used therein. A radioactive source could be formed from many nuclear waste materials. Natural uranium, or $^{238}U$, produces $2\times10^3$ fissions per second, or 64 nanowatts of power per gram of material. Gram quantities of $^{241}Am$ would produce 6 watts and of Pu would produce 60 watts for conversion to electricity. The polymer $VF_2/F_3E$ is advantageous for piezonuclear battery application but there are many piezoelectric materials, both polymer and ceramic, that would convert the applicable strains to electrical energy. The acoustic wave medium would be selected for maximum interaction with the particular particle emission, since alpha and beta emissions would need a medium where the stopping distance is sufficiently great to permit a useful transduction area for the piezoelectric film interaction.

The foregoing description of embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A piezonuclear battery, comprising:

a radioactive material forming an emitting surface for particle emissions;

acoustic wave generating means adjacent said emitting surface for receiving said emitted particles and interacting with said emitted particles to generate an acoustic wave; and piezoelectric means operably placed for receiving said acoustic wave and producing an output voltage with a predetermined polarity.

2. A piezonuclear battery according to claim 1, wherein said radioactive material is a fissionable material.

3. A piezonuclear battery according to claim 2, wherein said fissionable material is spontaneously fissionable.

4. A piezonuclear battery according to any of claims 1 through 3, wherein said acoustic wave generating means is neutron moderator.

5. A piezonuclear battery according to any of claims 1 through 3, wherein said piezoelectric means is a piezoelectric polymer.

6. A piezonuclear battery according to claim 5, wherein said piezoelectric polymer is a vinylidene fluoride/trifluorethylene copolymer.

7. A method for producing electrical energy directly from radioactive material, comprising the steps of:

emitting particles from said radioactive material;

interacting said particles with a medium for generating an acoustic wave; and directing said acoustic wave toward a piezoelectric material effective to generate an electrical voltage with a predetermined voltage from strains induced by said acoustic wave in said piezoelectric material.

* * * * *